US006331002B1

(12) United States Patent
Yoshino et al.

(10) Patent No.: US 6,331,002 B1
(45) Date of Patent: Dec. 18, 2001

(54) SHEET FEEDING APPARATUS

(75) Inventors: Hiroshi Yoshino, Kawasaki; Jun Katayanagi, Musashino; Haruyuki Yanagi, Machida; Shinya Sonoda, Yokohama; Yasuyuki Asai, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/627,451

(22) Filed: Jul. 27, 2000

(30) Foreign Application Priority Data

Jul. 29, 1999 (JP) ..... 11-215888

(51) Int. Cl.[7] ..... B65H 3/06
(52) U.S. Cl. ..... 271/117; 271/119; 271/124
(58) Field of Search ..... 271/117, 118, 271/119, 121, 124

(56) References Cited

U.S. PATENT DOCUMENTS

| | | | |
|---|---|---|---|
| 4,789,259 | 12/1988 | Katayanagi | 400/624 |
| 5,348,283 | 9/1994 | Yanagi et al. | 271/127 |
| 5,540,427 | 7/1996 | Nitta et al. | 271/274 |
| 5,580,042 | 12/1996 | Taniguro et al. | 271/274 |
| 5,620,174 | 4/1997 | Taniguro et al. | 271/10.12 |
| 5,648,808 | 7/1997 | Yanagi et al. | 347/104 |
| 5,672,019 | 9/1997 | Hiramatsu et al. | 400/624 |
| 5,725,319 | 3/1998 | Saito et al. | 400/629 |
| 5,899,613 | 5/1999 | Koike et al. | 399/384 |
| 5,918,873 | 7/1999 | Saito et al. | 271/10.11 |
| 5,934,664 * | 8/1999 | Murayama et al. | 271/118 |
| 6,217,017 * | 4/2001 | Yamazaki | 271/121 |

* cited by examiner

*Primary Examiner*—David H. Bollinger
(74) *Attorney, Agent, or Firm*—Fitzpatrick, Cella, Harper & Scinto

(57) ABSTRACT

The present invention provides a sheet feeding apparatus for separating and feeding sheets one by one, which has sheet stacking device for supporting sheets, a sheet feeding roller, provided at its periphery with a cylindrical surface and a cut-out portion, for feeding out the sheet stacked on the sheet stacking device by means of the cylindrical surface by rotating, separation device, capable of abutting against the sheet feeding roller, for separating the sheets one by one between the cylindrical surface of the sheet feeding roller and the separation device, spacing device for spacing apart the sheet feeding roller and the separation device when the cut-out portion of the sheet feeding roller is opposed to the separation device, biasing device for biasing the separation device to urge it against the sheet feeding roller or the spacing device, and conveying load reducing device for reducing a conveying load acting on the sheet being fed, by making an abutment force for pinching the sheet between the spacing device and the separation device smaller than an abutment force for pinching the sheet between the cylindrical surface and the separation device.

15 Claims, 9 Drawing Sheets

SHEET FEEDING APPARATUS

BACKGROUND OF THE INVENTION

1. Field of the Invention

The present invention relates to a sheet feeding apparatus for separating sheets stacked on a sheet stacking portion one by one and for feeding the separated sheet to an image forming apparatus.

2. Related Background Art

Among conventional image forming apparatus such as printers, copying machines, facsimiles and the like, there is an image forming apparatus in which an image is formed on a thick sheet such as a post card and an envelope or a special sheet such as a plastic thin plate, as well as a plain paper. In such an image forming apparatus, the feeding of the sheet to an image forming portion is effected by manual sheet insertion one by one or is effected by a sheet feeding apparatus automatically and continuously.

FIG. 10 shows a schematic construction of a printer as an example of an image forming apparatus having such a sheet feeding apparatus. In FIG. 10, a sheet P fed by a sheet feeding apparatus 1A for feeding sheets to printing means 4 one by one is conveyed while being pinched between conveying rollers 2, 3, and, after printing is effected by the printing means 4, the sheet is discharged out of the apparatus by discharge rollers 5, 6.

Such a sheet feeding apparatus 1A is disclosed in Japanese Utility Model Publication No. 8-3396, for example, and FIG. 11 shows a construction of such an apparatus.

In FIG. 11, a sheet feeding roller 10 having a D-shaped cross-section has a cylindrical portion 10*a* and a straight portion 10*b*. Incidentally, a shaft 10*c* of the sheet feeding roller 10 is supported by a guide block 11. Further, a cassette 12 has therein a stacking plate 12*a* on which a plurality of sheets are set in a stacked condition. By a biasing force of a spring 12*c* for biasing the stacking plate 12*a*, a sheet stack P stacked (rested) on the stacking plate is biased toward the sheet feeding roller 10.

A separation pad 13 attached to a bracket 13*a* is disposed in a rotational movement path of the cylindrical portion 10*a* of the sheet feeding roller 10 and is biased the shaft 10*c* of the sheet feeding roller along a guide 15 by means of a spring 14.

An idle (idler) roller 16 is rotatably attached to the guide block 11, and a movable idle roller 17 is attached in an elongated groove 11*a* of the guide block 11 via a shaft 17*a* for shifting movement. The movable idle roller 17 is biased toward the separation pad 13 by a spring 18 to abut against the separation pad 13. Incidentally, a biasing force F2 of the spring 18 is selected to be smaller than a biasing force F1 of the spring 14 of the separation pad 13 (i.e., F1>F2).

Further, when it is assumed that a friction force between the cylindrical portion 10*a* of the sheet feeding roller 10 and an uppermost sheet P1 in the sheet stack is f1, a friction force between a next sheet P2 and the separation pad 13 is f2, and a friction force between the uppermost sheet P1 and the next sheet P2 is f3, coefficients of friction of the sheet feeding roller 10 and the separation pad 13 are selected to satisfy the following relationship:

$$f1>f2>f3.$$

Now, a sheet feeding operation of the sheet feeding apparatus 1A will be explained.

In a waiting condition, as shown in FIG. 11, the straight portion 10*b* of the sheet feeding roller 10 is opposed to the sheet stack P so that the sheet feeding roller 10 is not contacted with the sheet P. Further, since the biasing force F2 of the spring 18 of the movable idle roller 17 is smaller than the biasing force F1 of the spring 14 of the separation pad 13, the movable idle roller 17 is pushed upwardly by the separation pad 13 so that the shaft 17*a* abut against an upper end of the elongated groove 11*a*.

When the sheet feeding operation is started, the sheet feeding roller 10 is rotated in a direction shown by the arrow, and, by contacting the circular portion 10*a* with the uppermost sheet P1 in the sheet stack P, the uppermost sheet P1 is sent toward the separation pad 13. In this case, due to the friction force between the sheet P1 and the next sheet P2, the next sheet P2 may be sent together with the uppermost sheet P1. However, the next sheet P2 is separated from the uppermost sheet P1 by the separation pad 13 in the following manner, and only the uppermost sheet P1 is fed.

When a leading end of the next sheet P2 abut against the separation pad 13, the movement of the next sheet is prevented to primarily separate the next sheet from the uppermost sheet P1. Further, as mentioned above, since the friction force f1 between the cylindrical portion 10*a* of the sheet feeding roller 10 and the uppermost sheet P1, the friction force f2 between the next sheet P2 and the separation pad 13 and the friction force f3 between the uppermost sheet P1 and the next sheet P2 are selected to satisfy the relationship f1>f2>f3, as the sheet feeding roller is rotated, when both the uppermost sheet P1 and the next sheet P2 are pinched between the cylindrical portion 10*a* of the sheet feeding roller 10 and the separation pad 13, the next sheet P2 a prevented from being moved by the friction force f2 between the separation pad 13 and the next sheet and is secondarily separated from the uppermost sheet P1, with the result that only the uppermost sheet P1 is fed.

Thereafter, when the sheet feeding roller 10 is further rotated, the sheet feeding roller 10 is returned to the waiting condition where the separation pad 13 is not urged by the cylindrical portion 10*a*, as shown in FIG. 11. Incidentally, in this case, due to the difference between the biasing forces F1, F2 of the springs 14, 18, a separation pad 13 is stopped in a condition that the movable idle roller 17 is pushed upwardly until the shaft 17*a* abuts against the upper end of the elongated groove 11*a*.

By the way, since the separation pad 13 is disposed in the rotational movement path of the cylindrical portion 10*a* of the sheet feeding roller 10, as the cylindrical portion 10*a* is rotated, the separation pad 13 is pushed downwardly by the cylindrical portion 10*a*. Since the movable idle roller 17 is biased toward the separation pad 13 by the spring 18, even when the separation pad 13 is pushed downwardly, the movable idle roller abuts against the separation pad 13, and this abutment aids the separating operation.

Further, by adopting the arrangement in which the movable idle roller 17 is biased toward the separation pad 13 to pinch the sheet P1 between the movable idle roller and the separation pad 13, even when the friction force acts between the uppermost sheet P1 and the next sheet P2, while the sheet P1 is being conveyed by the conveying rollers 2, 3, the next sheet P2 can be prevented from being sent together with the uppermost sheet P1.

By the way, when such a conventional sheet feeding apparatus is used in the printer as shown in FIG. 10, the fed sheet P1 is conveyed while being pinched between the conveying rollers 2, 3 and is printed by the printing means 4. In this case, when the conveyance of the sheet P1 by the conveying rollers 2, 3 is started, normally, the sheet P1 is not completely left from the sheet feeding apparatus 1A. That is to say, a trailing end portion of the sheet P1 is pinched between the separation pad 13 and the movable idle roller 17, and the sheet P1 is conveyed by the conveying rollers 2, 3 in this condition.

Accordingly, the sheet P1 is conveyed by the conveying rollers 2, 3 in a condition that the sheet is subjected to load due to the pinching (in a condition that the load acts on the trailing end of the sheet) until the trailing end of the sheet leaves the nip between the separation pad 13 and the movable idle roller 17.

As mentioned above, since the separation pad 13 serves to prevent double-feeding by pinching the sheet P between the separation pad and the cylindrical portion 10*a* of the sheet feeding roller 10, the biasing force F1 is required to be set relatively greatly. However, when the biasing force F1 is so set, the load acting on the sheet P1 in the pinched condition becomes great.

When the load acting on the sheet P1 in the pinched condition becomes great, if a conveying force sufficient to overcome this load is not obtained by the conveying rollers 2, 3, since the sheet feeding accuracy is reduced, the printing accuracy of the printing means 4 is also reduced.

Incidentally, in order to obtain the conveying force sufficient to overcome this load, for example, if the sheet pinching force between the conveying rollers 2, 3 is increased and a driving force for driving the conveying rollers 2, 3 is increased, the entire apparatus will be made bulky and/or power consumption will be increased. Further, the wear of the conveying rollers 2, 3 will be increased.

SUMMARY OF THE INVENTION

The present invention aims to eliminate the above-mentioned conventional drawbacks, and an object of the present invention is to provide a sheet feeding apparatus and an image forming apparatus having such a sheet feeding apparatus, in which sheets are can be separated and fed one by one without reducing sheet feeding accuracy.

To achieve the above object, the present invention provides a sheet feeding apparatus for separating and feeding sheets one by one, comprising sheet stacking means for supporting sheets, a sheet feeding roller, provided at its periphery with a cylindrical surface and a cut-out portion, for feeding out the sheet stacked on the sheet stacking means by means of the cylindrical surface, by rotating separation means, capable of abutting against the sheet feeding roller, for separating the sheets one by one between the cylindrical surface of the sheet feeding roller and the separation means, spacing means for spacing apart the sheet feeding roller and the separation means when the cut-out portion of the sheet feeding roller is opposed to the separation means, biasing means for biasing the separation means to urge it against the sheet feeding roller or the spacing means, and conveying load reducing means for reducing a conveying load acting on the sheet being fed, by making an abutment force for pinching the sheet between the spacing means and the separation means smaller than an abutment force for pinching the sheet between the cylindrical surface and the separation means.

The present invention further provides a sheet feeding apparatus for separating and feeding sheets one by one, comprising sheet stacking means for supporting sheets, a sheet feeding roller, provided at its periphery with a cylindrical surface and a cut-out portion, for feeding out the sheet stacked on the sheet stacking means by means of the cylindrical surface by rotating separation means, capable of abutting against the sheet feeding roller, for separating the sheets one by one between the cylindrical surface of the sheet feeding roller and the separation means, an idler sub-roller, disposed in coaxial with the sheet feeding roller, for spacing the sheet feeding roller and the separation means apart from each other when the cut-out portion of the sheet feeding roller is opposed to the separation means, biasing means for biasing the separation means toward the sheet feeding roller, drive control means for rotating the sheet feeding roller to feed out the sheet and for stopping the sheet feeding roller at a position where the cut-out portion is opposed to the separation means, and conveying load reducing means for stopping the sheet feeding roller on the way of the sheet feeding by the drive control means, by setting an abutment force for pinching the sheet between the idler sub-roller and the separation means to be smaller than an abutment force for pinching the sheet between the cylindrical surface and the separation means, thereby more reducing a conveying load acting on the sheet when the sheet is pinched between the idler sub-roller and the separation means than when the sheet is pinched between and separated by the cylindrical surface and the separation means.

DETAILED DESCRIPTION OF THE PREFERRED EMBODIMENTS

The present invention will now be fully explained in connection with embodiments thereof with reference to the accompanying drawings.

Figure 1:
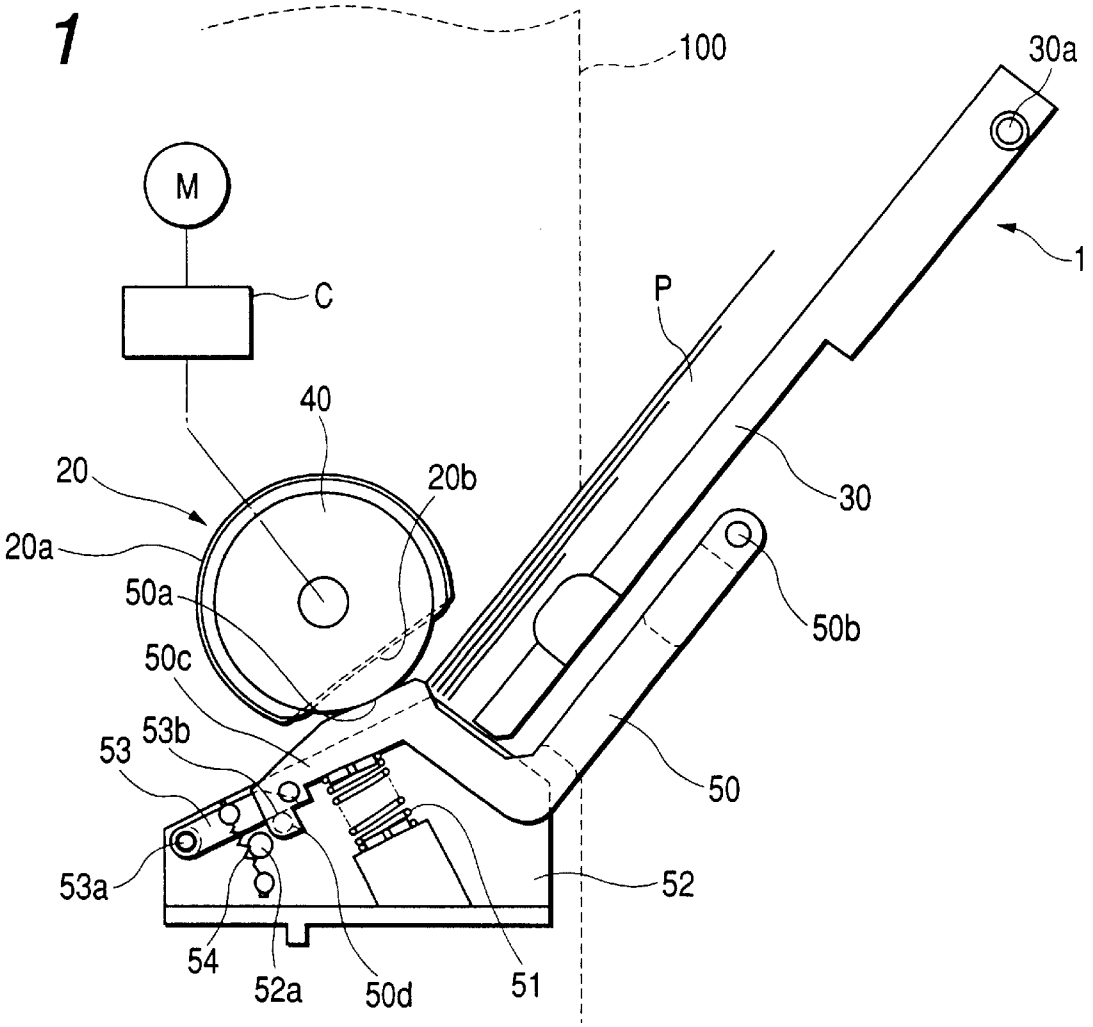
FIG. 1 is a schematic sectional view of a sheet feeding apparatus according to a first embodiment of the present invention.

First of all, a first embodiment of the present invention will be described with reference to FIGS. 1 to 6. FIG. 1 is a schematic sectional view of a sheet feeding apparatus according to a first embodiment of the present invention, and FIG. 2 is a top plan view of separation means of the sheet feeding apparatus.

Figure 2:
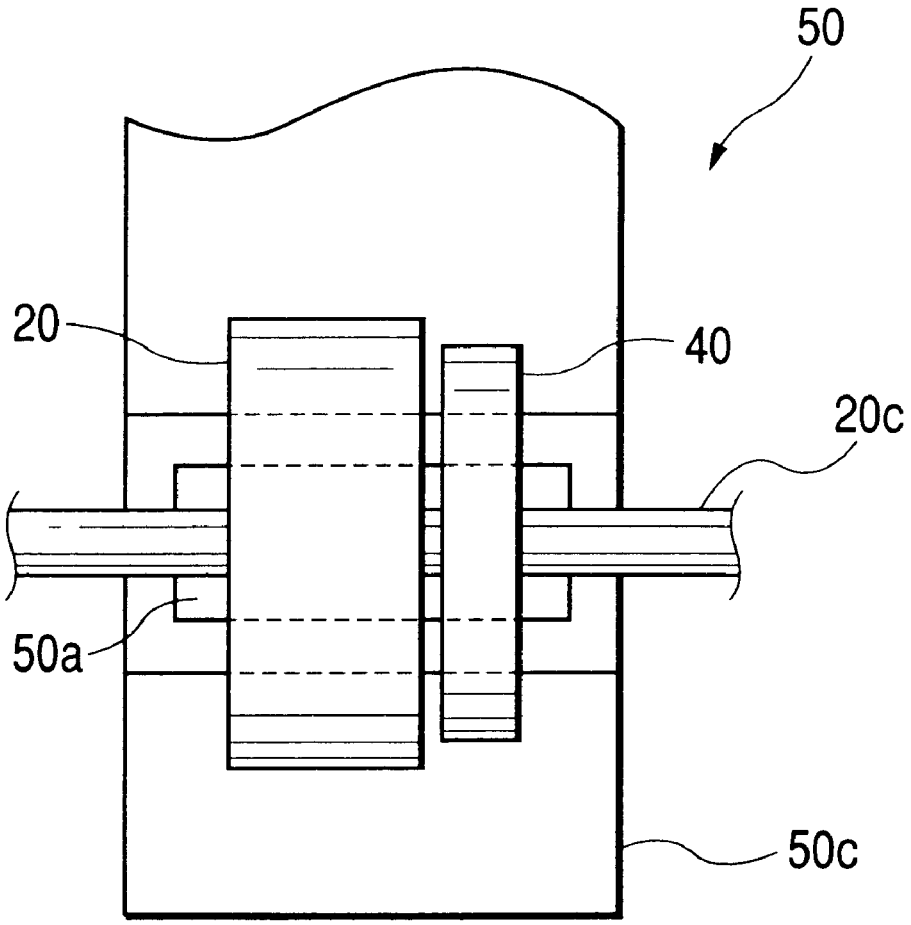
FIG. 2 is a top plan view of separation means of the sheet feeding apparatus.

In FIGS. 1 and 2, a sheet feeding apparatus 1 incorporated into an image forming apparatus 100 serves to feed out sheets P stacked on a resting plate 30 as sheet stacking means for supporting the sheets in an inclined condition toward an image forming portion (not shown) of the image forming apparatus 100 by a sheet feeding roller 20 having a D-shaped cross-section as sheet feeding means.

The sheet feeding roller 20 is rotated by a driving force from a drive source M such as a motor of the image forming apparatus 100 and has a cut-out portion 20*b* formed by straightly cutting a peripheral surface of the roller, and a cylindrical portion 20*a* capable of abutting against the sheet P. Drive control means C such as a clutch for controlling the rotation of the sheet feeding roller 20 are provided between the drive source M and the sheet feeding roller 20, and, in the illustrated embodiment, the sheet feeding roller 20 is stopped whenever it is rotated by one revolution by means of the drive control means C.

When a sheet feeding operation is being performed, the cylindrical portion 20*a* is contacted with an uppermost sheet P1 in the sheet stack P rested on the resting plate 30 so that the sheet P1 is fed by a friction force. Incidentally, when the sheet feeding operation is not effected, as shown in FIG. 1, the cut-out portion 20*b* is opposed to the sheet stack P.

The resting plate 30 is rotatably attached to a main body (not shown) of the sheet feeding apparatus via a rotary shaft 30*a* and is biased toward the sheet feeding roller 20 by a spring (not shown), so that the sheets P stacked on the resting plate 30 are biased toward the sheet feeding roller 20. Incidentally, the resting plate 30 can be moved toward and away from the sheet feeding roller 20 by a cam (not shown) rotated in synchronous with the rotation of the sheet feeding roller 20 in response to one revolution sheet feeding operation of the sheet feeding roller 20.

Further, in FIGS. 1 and 2, a separation plate 50 holds a separation pad 50*a*. The separation plate 50 is rotatably attached to the main body (not shown) of the sheet feeding apparatus via a rotary shaft 50*b* is biased by a separation spring 51 as biasing means disposed between a base 52 and the separation plate in such a manner that the separation pad 50*a* adhered to an upper surface of a shifting end 50*c* is urged against the sheet feeding roller 20. By rotating the cylindrical portion 20*a* while being urged against the separation pad 50*a*, separation and feeding of the sheets are effected.

Further, an idle roller 40 is a rotary member rotatably attached to a sheet feeding roller shaft 20*c* at a side of the sheet feeding roller 20. The idle roller 40 serves to prevent a second sheet P2 and other sheets from being conveyed together with the uppermost sheet P1 into the image forming apparatus after the sheet feeding operation.

The idle roller 40 has a diameter slightly smaller than a diameter of the cylindrical portion 20*a* of the sheet feeding roller 20 so that, when the cylindrical portion 20*a* of the sheet feeding roller 20 does not abut against the separation pad 50*a*, i.e., when the cut-out portion 20*b* of the sheet feeding roller 20 is opposed to the separation pad 50*a*, as shown in FIG. 1, in place of the sheet feeding roller 20, the idle roller 40 cooperates with the separation pad 50*a* to pinch the sheet therebetween and is rotatingly driven by the movement of the sheet being fed. With this arrangement, only the uppermost sheet P1 is fed out, and the next sheet P2 and other sheets are prevented from being conveyed together with the uppermost sheet P1 into the image forming apparatus.

Since there is a predetermined diameter difference between the cylindrical portion 20*a* of the sheet feeding roller 20 and the idle roller 40, a length of the separation spring 51 when the separation pad 50*a* abuts against the cylindrical portion 20*a* of the sheet feeding roller 20 differs from that when the separation pad 50*a* abuts against the idle roller 40. That is to say, in comparison with the case where the separation pad 50*a* abuts against the cylindrical portion 20*a* of the sheet feeding roller 20, the length of the separation spring 51 becomes longer when the separation pad 50*a* abuts against the idle roller 40.

Thus, when the separation pad 50*a* abuts against the idle roller 40, abutment pressure smaller than that obtained when the separation pad 50*a* abuts against the cylindrical portion 20*a* of the sheet feeding roller 20 can be obtained. As an example, when it is assumed that a spring constant of the separation spring 51 is 15 gf/mm ($15\times10^{-3}\times9.8=1.47\times10^{-1}$ N/mm) and the difference in diameter between the idle roller 40 and the cylindrical portion 20*a* of the sheet feeding roller 20 is 3 mm, the abutment pressure of the separation pad 50*a* can be changed by about 45 gf ($45\times10^{-3}\times9.8=4.41\times10^{-1}$ N).

By reducing the abutment pressure between the idle roller 40 and the separation pad 50*a* in this way, a load (conveying load) for pulling the sheet pinched between the idle roller 40 and the separation pad 50*a* can be reduced.

Next, conveying load reducing means which is a main component of the present invention will be explained.

In FIG. 1, a pressure reduction lever 53 constitutes opposite direction biasing means and serves to bias the separation plate 50 toward an opposite direction away from the idle roller 40 thereby to reduce the abutment pressure between the separation pad 50*a* and the idle roller 40, by engaging with a protruded portion 50*d* provided on the shifting end 50*c* of the separation plate 50 when the separation pad 50*a* abuts against the idle roller 40.

The pressure reduction lever 53 is rotatably supported by the base 52 via a rotary shaft 53*a* and is biased downwardly (clockwise direction) by a pressure reduction lever spring 54 connected between the pressure reduction lever 53 and the base 52. A tip end portion 53*b* of the pressure reduction lever 53 can be engaged by the protruded portion 50*d* of the shifting end 50*c* of the separation plate 50 when the separation plate 50 abuts against the idle roller 40. Upon engagement, a spring force of the pressure reduction lever spring 54 directing toward a direction opposite to the direction along which the separation plate 50 is urged against the idle roller 40 by the separation spring 51 is applied to the separation plate 50. Incidentally, the elastic force of the separation spring 51 is set to be greater than the elastic force of the pressure reduction lever spring 54.

In other words, when the separation pad 50*a* abuts against the idle roller 40, the separation plate 50 is rotated upwardly in opposition to the spring force of the pressure reduction lever spring 54. When the separation pad 50*a* abuts against the idle roller 40 in this way, the spring force of the pressure reduction lever spring 54 acts on the separation plate 50, thereby reducing the abutment pressure between the separation pad 50*a* and the idle roller 40.

Incidentally, by providing a lever stopper 52*a* formed on the base 52 holding the pressure reduction lever 53, as will be described later, during the sheet feeding operation, when the separation plate 50 is urged by the cylindrical portion 20*a* of the sheet feeding roller 20 to be lowered together with the pressure reduction lever 53, the lowering of the pressure reduction lever 53 is regulated.

Next, the sheet feeding operation of the sheet feeding apparatus 1 having the above-mentioned construction will be explained with reference to FIGS. 3 to 5.

Figure 3:
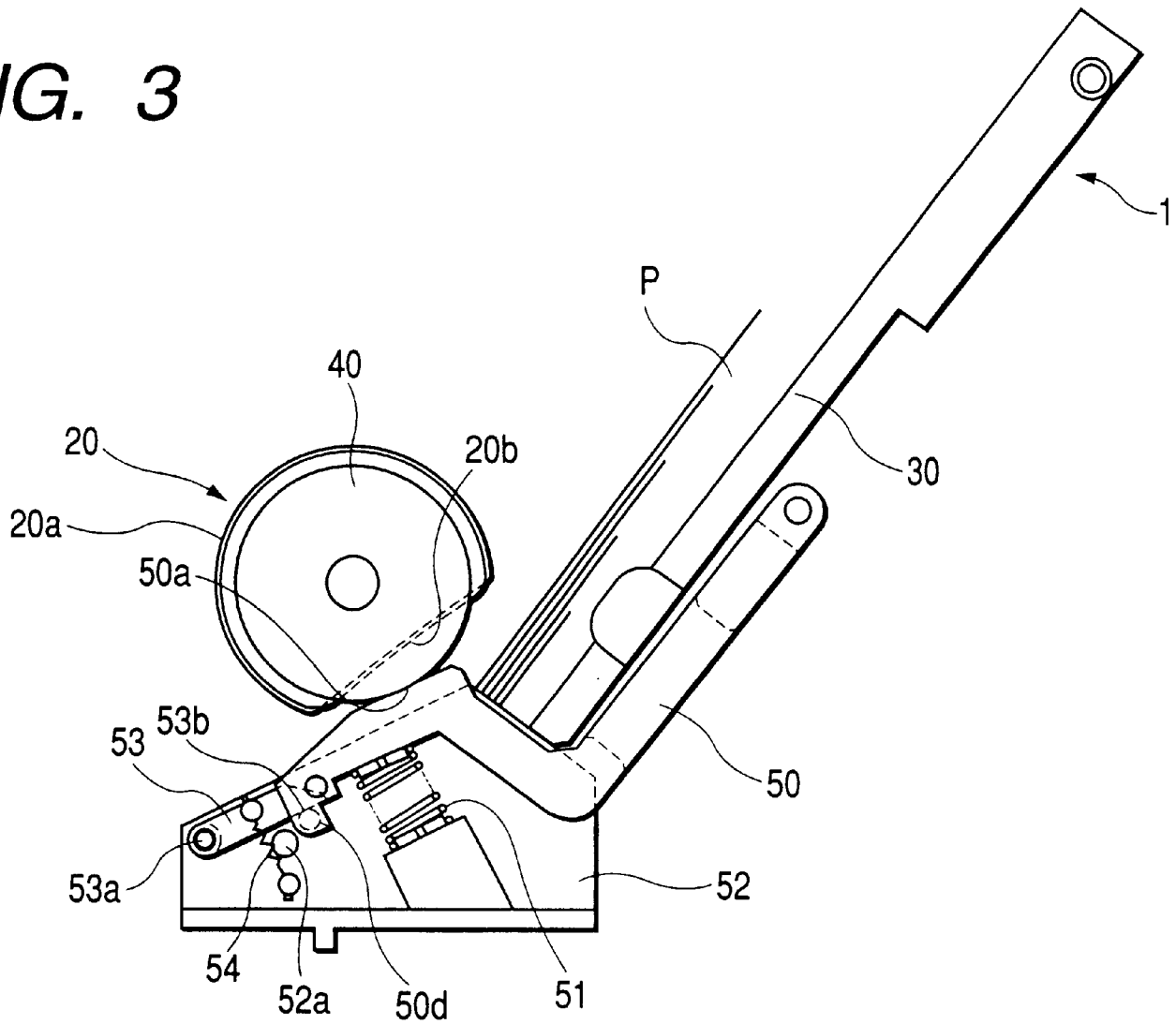
FIG. 3 is a view showing the sheet feeding apparatus before a sheet feeding operation is effected.
Figure 4:
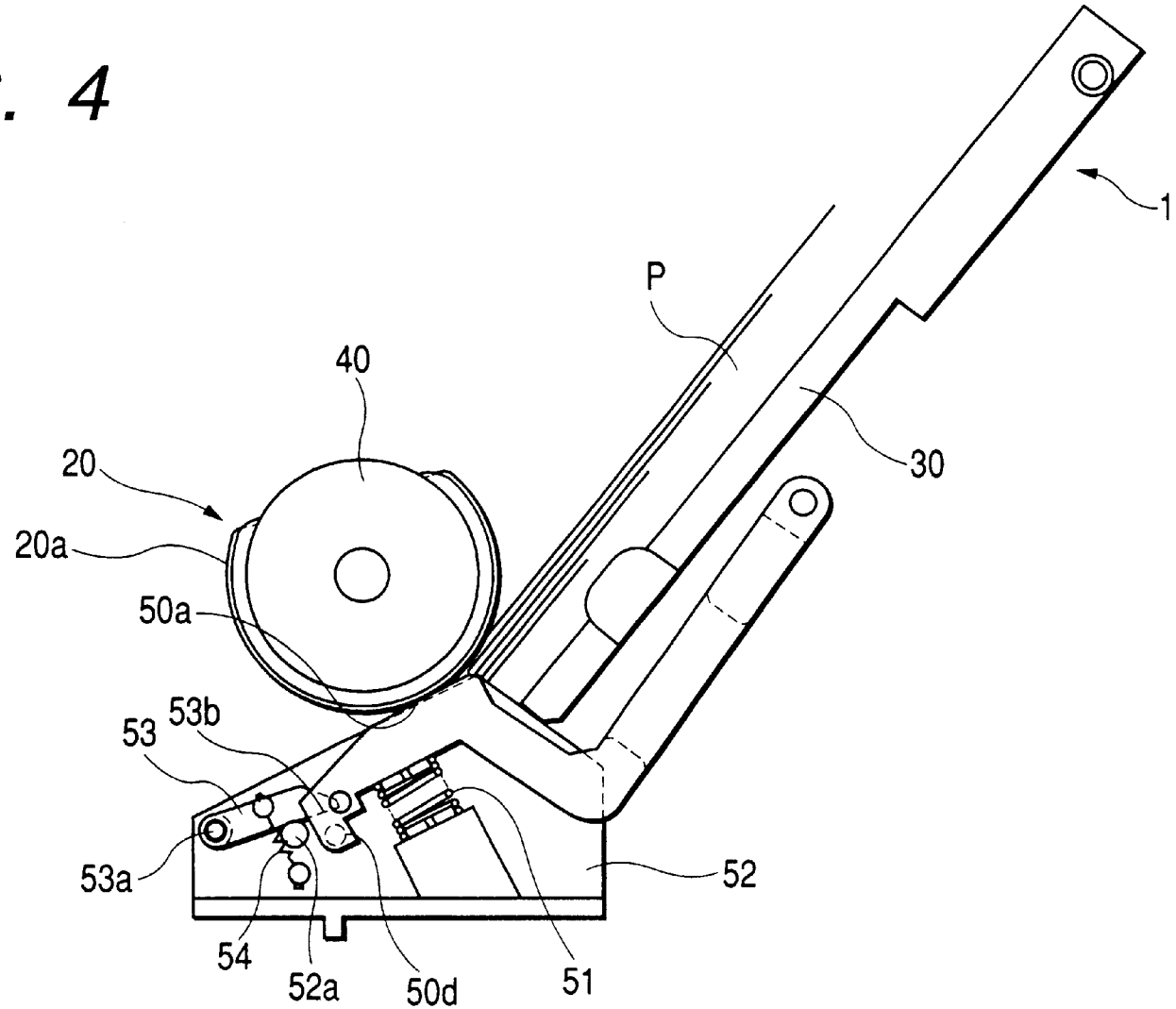
FIG. 4 is a view showing the sheet feeding apparatus while the sheet feeding operation is being effected.

FIG. 3 is a view showing a condition before the sheet feeding operation is started. In this condition, the sheets P are stacked on the resting plate 30, and the separation plate

50 is biased by the separation spring 51 so that the separation pad 50*a* provided on the shifting end 50*c* abuts against the idle roller 40.

In this case, although the separation pad 50*a* is urged against the idle roller 40 by the separation spring 51, since the tip end portion 53*b* of the pressure reduction lever 53 is contacted with the protruded portion 50*d* of the separation plate 50 to act the spring force of the pressure reduction lever spring 54 on the separation plate 50, the abutment pressure between the separation pad 50*a* and the idle roller 40 is reduced.

When the sheet feeding operation is started, first of all, the sheet feeding roller is rotated in the direction shown by the arrow. Then, in response to the rotation of the sheet feeding roller 20, the resting plate 30 is lifted to a position shown by the solid line in FIG. 4 by the cam (not shown) and the spring (not shown), with the result that the uppermost sheet P1 in the sheet stack P rested on the resting plate 30 is contacted with the cylindrical portion 20*a* of the sheet feeding roller 20. Thereafter, when the sheet feeding roller 20 is further rotated, the uppermost sheet P1 is fed above the separation pad 50*a*.

In this case, a plurality of sheets including the uppermost sheet P1 may be fed above the separation pad 50*a* together with the uppermost sheet p1. In such a case, in accordance with the frictional separation principle based on the above-mentioned relationship (f1>f2>f3) between the coefficients of friction, only the uppermost sheet P1 is fed out, as shown in FIG. 4. That is to say, even if the plural sheets enter onto the separation pad, in this stage, only the uppermost sheet P1 can be separated and fed. Further, the length of the separation spring in this condition is L1, thereby providing optimum spring pressure for frictional separation.

In this case, although the separation plate 50 is urged by the cylindrical portion 20*a* of the sheet feeding roller 20 to be lowered together with the pressure reduction lever 53, the lowering of the pressure reduction lever 53 is regulated by the lever stopper 52*a* provided on the base 52. Thus, in a condition that the separation plate 50 is completely lowered, the abutment between the tip end portion 53*b* of the pressure reduction lever 53 and the protruded portion 50*d* of the separation plate 50 is released, with the result that the spring force of the pressure reduction lever spring 54 does not act on the separation plate 50. As a result, the abutment pressure between the sheet feeding roller 20 and the separation pad 50*a* sufficient to separate the sheets is maintained.

Figure 5:
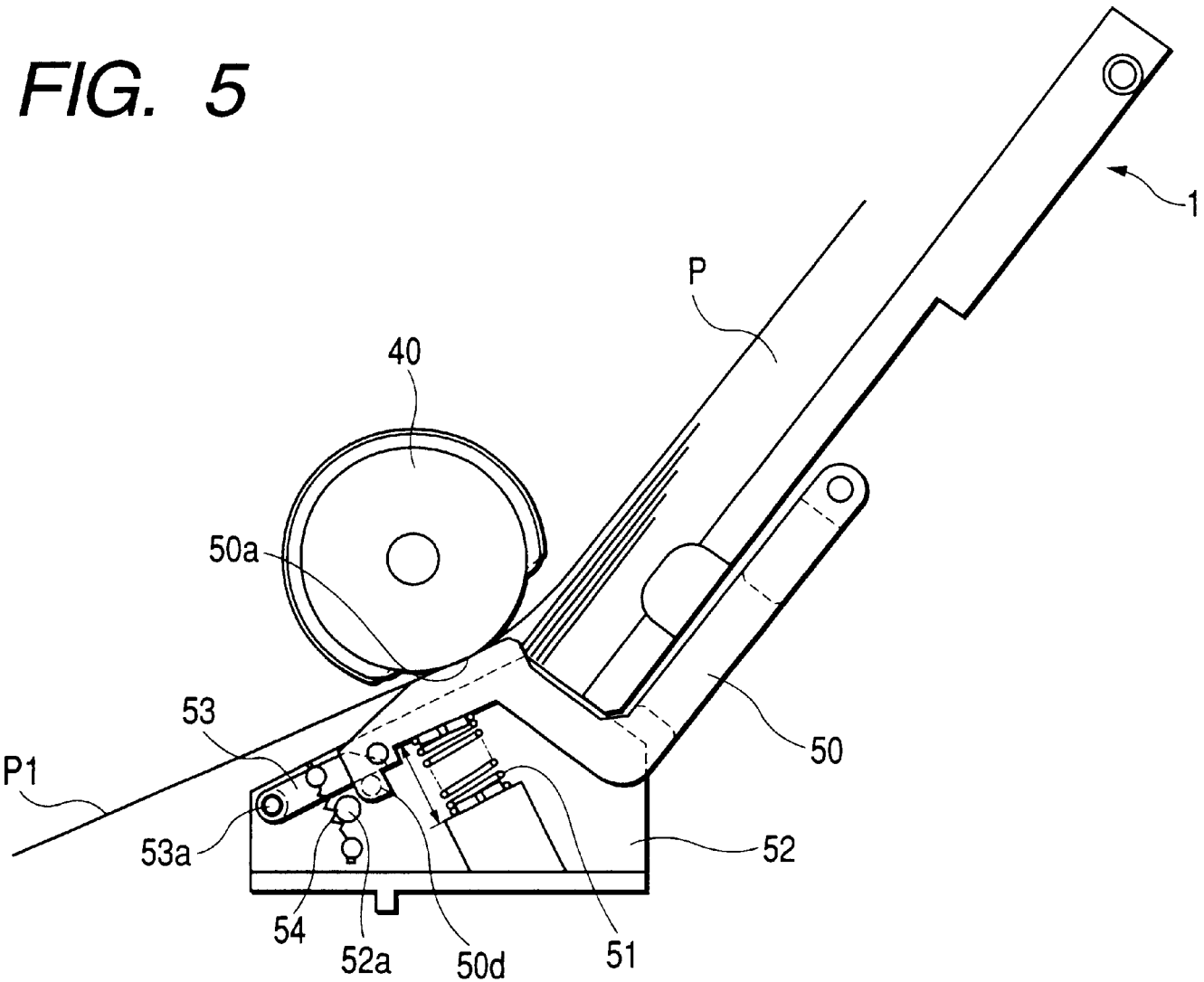
FIG. 5 is a view showing the sheet feeding apparatus immediately after the sheet feeding operation is started.

Thereafter, when the sheet feeding roller 20 is further rotated, as shown in FIG. 5, the uppermost sheet P1 is pinched between the idle roller 40 and the separation pad 50*a*. In this case, the length of the separation spring 51 becomes L2 due to the difference in diameter between the idle roller 40 and the sheet feeding roller 20, with the result that the idle roller 40 abuts against the separation pad 50*a* with weaker pressure than the pressure obtained when the length of the separation spring 51 is L1.

Figure 10:
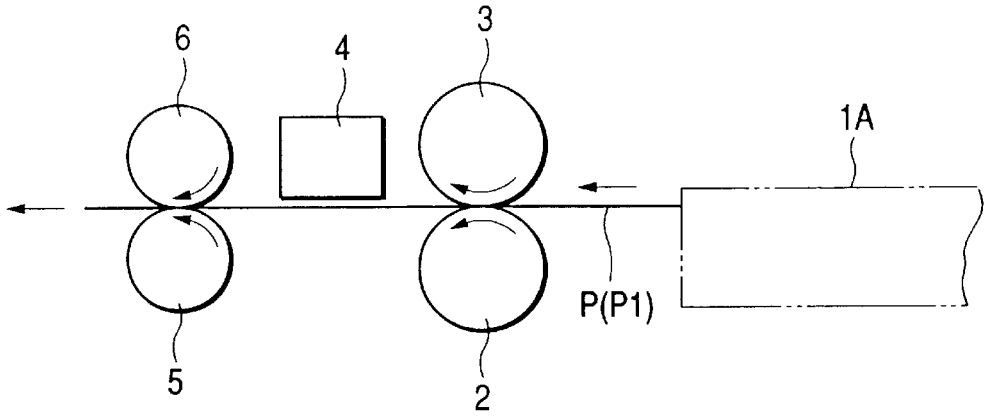
FIG. 10 is a view showing a schematic construction of a printer as an example of an image forming apparatus having a conventional sheet feeding apparatus.
Figure 11:
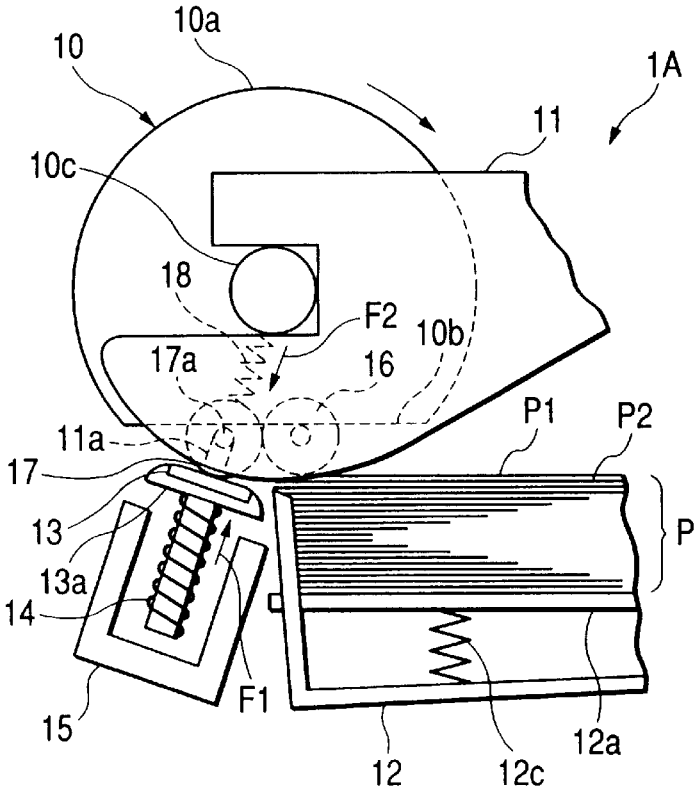
FIG. 11 is a view showing a construction of a conventional sheet feeding apparatus.

In the case where the idle roller 40 abuts against the separation pad 50*a* with weak pressure in this way, when the sheet P1 is conveyed by the conveying rollers 2, 3 (FIG. 10), fictional load acting on the sheet P1 at the contact area between the idle roller 40 and the separation pad 50*a* can be reduced.

Further, as mentioned above, when the separation pad 50*a* abuts against the idle roller 40, by the conveying load reducing means constituted by the pressure reduction lever 53 and the pressure reduction lever spring 54, the separation plate 50 is rotated upwardly while being regulated by the spring force of the pressure reduction lever spring 54, thereby reducing the abutment pressure between the separation pad 50*a* and the idle roller 40.

Thus, when the uppermost sheet P1 is conveyed, the resistance force acting on the sheet P1 generated between the idle roller 40 and the separation pad 50*a* can be reduced, with the result that the pulling load (conveying load) for pulling the sheet P1 pinched between the idle roller 40 and the separation pad 50*a* can be reduced, thereby feeding the sheet P1 without worsening the sheet feeding accuracy. Further, since the abutment pressure between the idle roller 40 and the separation pad 50*a* is reduced, scratches generated on the surfaces of the uppermost sheet P1 during the conveyance can be suppressed. In addition, since the conveying force required for the conveying rollers 2, 3 can be reduced, the cost of the entire apparatus can be reduced.

Figure 6:
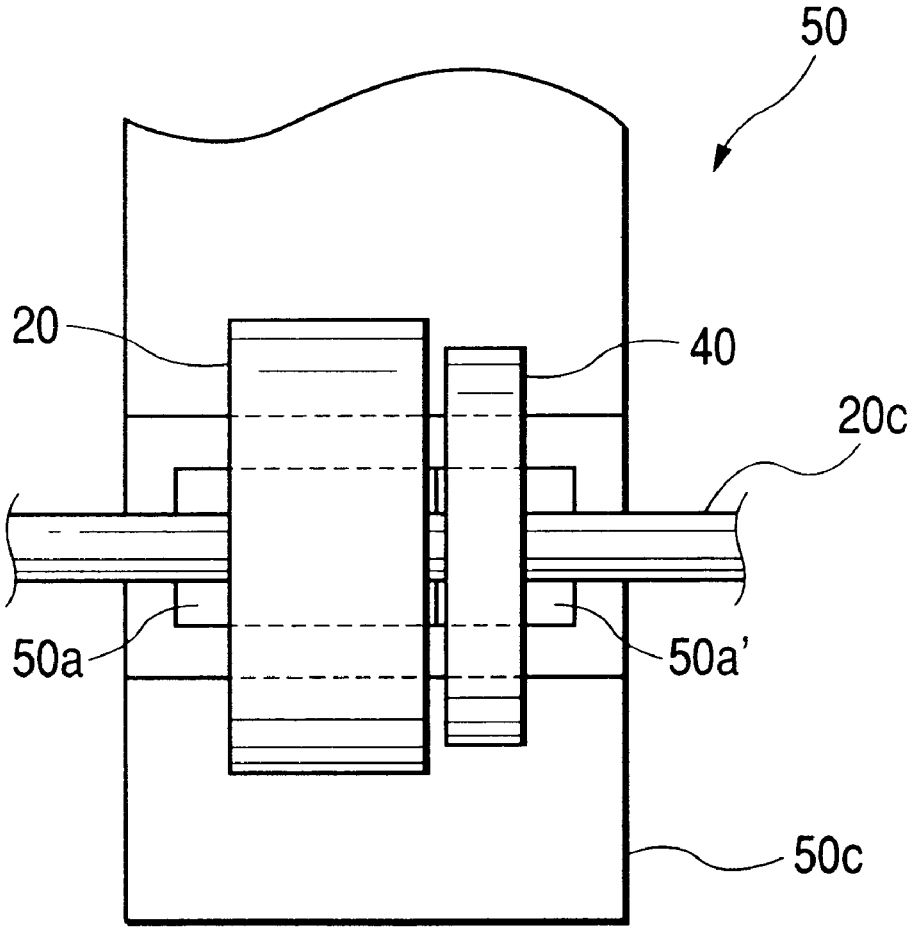
FIG. 6 is a top plan view showing another example of separation means.

FIG. 6 shows another embodiment of a separation pad. In FIG. 6, a separation pad 50*a*' opposed to the idle roller 40 is formed from a member having a coefficient of friction smaller than that of the separation pad 50*a* associated with the sheet feeding roller 20 by a predetermined amount.

By adopting an arrangement in which the coefficient of friction of the separation pad 50*a*' urged against the idle roller 40 is smaller than the coefficient of friction of the separation pad 50*a* urged against the sheet feeding roller 20, the conveying load can be reduced effectively.

Next, a second embodiment of the present invention will be explained.

Figure 7:
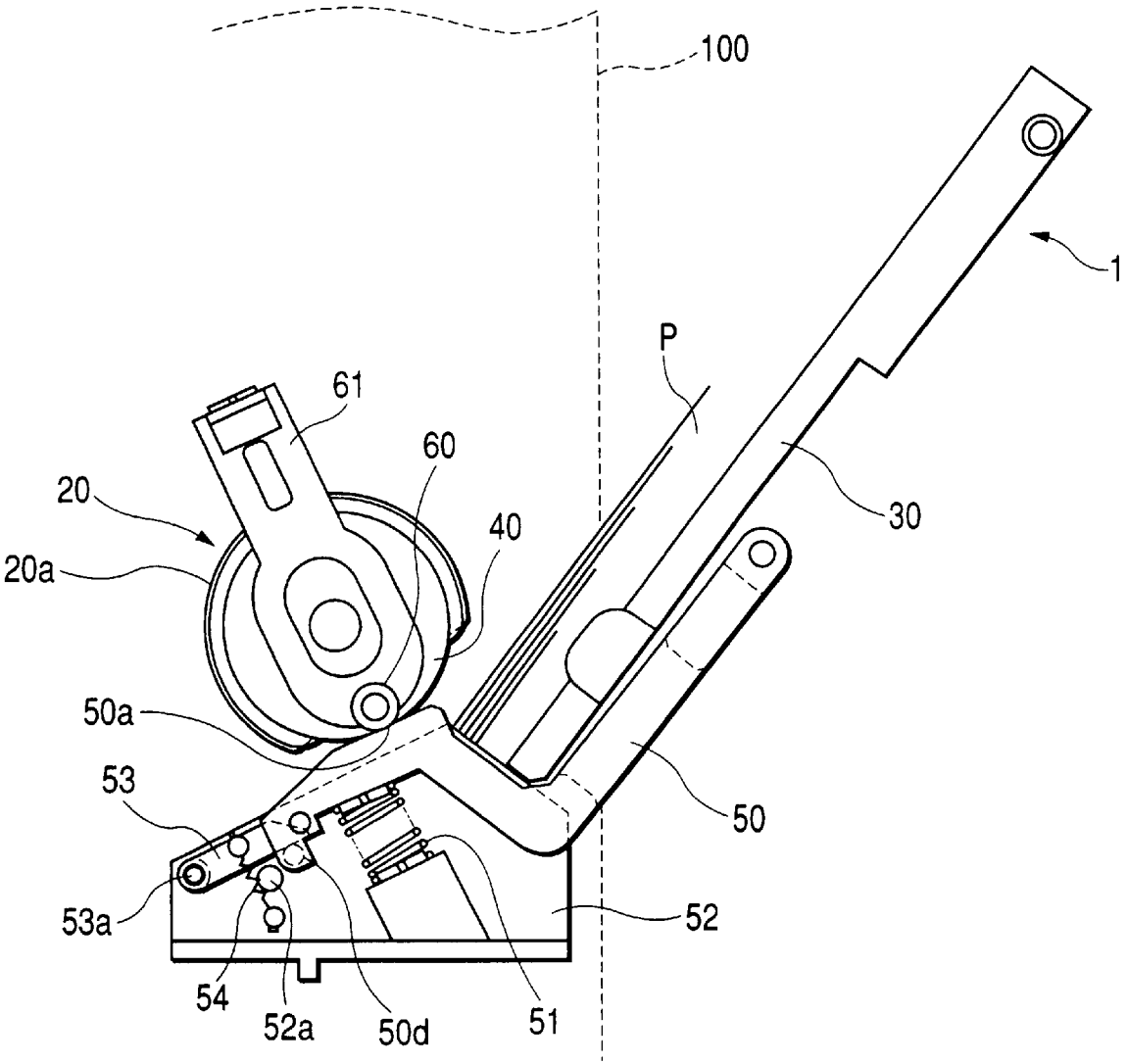
FIG. 7 is a schematic sectional view of a sheet feeding apparatus according to a second embodiment of the present invention.

FIG. 7 is a schematic sectional view of a sheet feeding apparatus according to a second embodiment of the present invention. In FIG. 7, the same elements as those in the first embodiment are designated by the same reference numerals.

In FIG. 7, a movable idle roller 60 as sheet pressing means for urging the sheet against the pad in the vicinity of a contact area between the idle roller 40 and the separation pad 50*a* is rotatably attached to an idle roller holder 61. Further, the idle roller holder 61 is biased toward the separation pad 50*a* by biasing means such as a spring (not shown) and is held by the main body of the sheet feeding apparatus for movement in an up-and-down direction so that the idle roller 60 can follow the movement of the separation plate 50 as shown in FIG. 5 during the sheet feeding operation, i.e., the movable idle roller 60 can always abut against the separation pad 50*a*.

Now, special function and effect of the movable idle roller 60 will be described.

Figure 8:
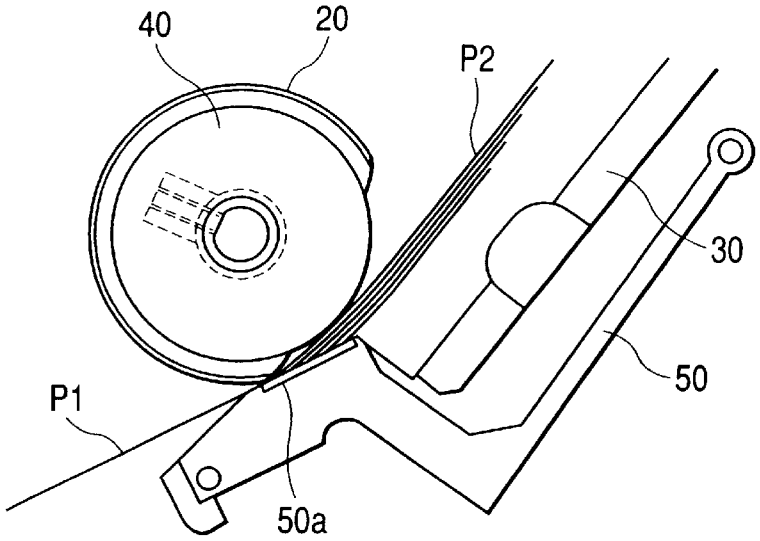
FIG. 8 is a view showing a condition immediately before the sheet feeding operation is finished under a special condition, in the first embodiment.

FIG. 8 shows a condition immediately before the sheet feeding operation is finished under the special condition in the first embodiment. Here, the special condition is a condition in which various conditions such as a condition that the weight of the sheet P itself is great, a condition that the stacking angle of the sheet stack is near vertical and a condition that the coefficient of friction of the separation pad 50*a* is small are combined or overlapped. In such a case, as shown in FIG. 8, a plurality of sheets including the uppermost sheet P1 and the next sheet P2 may enter onto the separation pad 50*a*.

If the sheet feeding operation is finished in this condition, when the separation pad 50*a* abut against the idle roller 40 with weak pressure, the plural sheets are pinched between the separation pad 50*a* and the idle roller 40, with the result that, when the conveyance of the conveying rollers 2, 3 is effected, the plural sheets including the next sheet P2 may enter into the image forming apparatus.

To avoid this, as is in the second embodiment, the movable idle roller 60 always contacted with the separation pad 50*a* is additionally provided, so that, immediately before the sheet feeding operation is finished, by urging the sheet P against the separation pad 50*a* in the vicinity of the contact area between the idle roller 40 and the separation pad 50*a* the sheet P can be held by the idle roller 40 more positively after the sheet feeding operation.

With this arrangement, after the abutment between the cylindrical portion 20*a* of the sheet feeding roller 20 and the separation pad 50*a* with the interposition of the sheet P is released, inconvenience that both the uppermost sheet P1 and the next sheet P2 are fed can be prevented, thereby providing a sheet feeding apparatus 1 performing more reliable operation.

Figure 9:
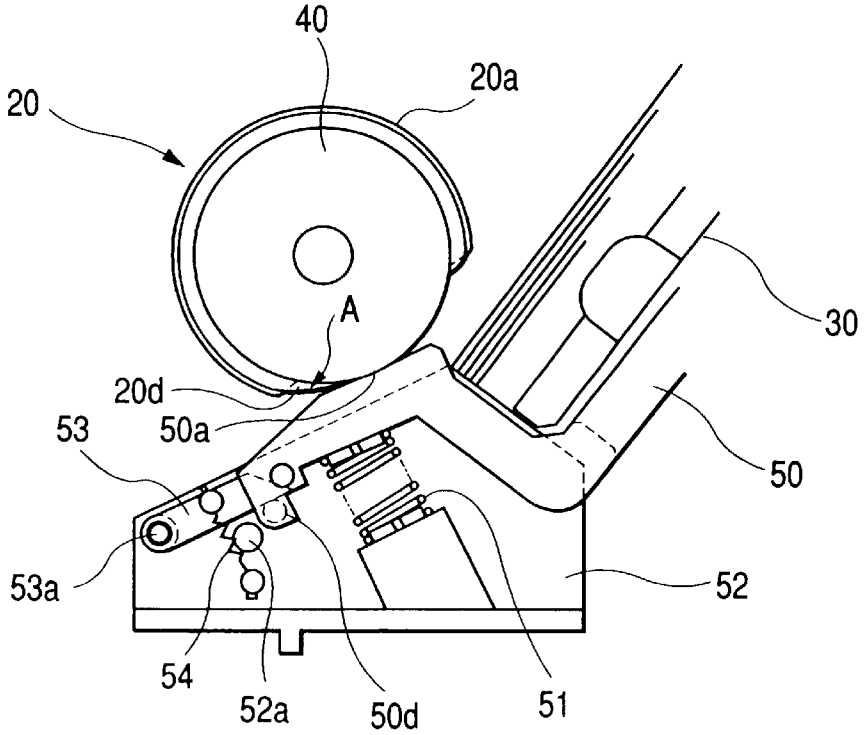
FIG. 9 is a view showing a construction in place of a movable idler sub-roller shown in FIG. 8.

The illustrated embodiment is not limited to the above-mentioned construction, but, in place of the movable idle roller 60, as shown in FIG. 9, as sheet pressing means, a sheet feeding roller in which a flange 20*d* is integrally formed with a stepped portion A near a rearmost part of the sheet feeding roller 20 among stepped portions between the sheet feeding roller 20 and the idle roller 40 may be used. Further, as sheet pressing means, even when a lever member always biased toward the separation pad 50*a* is used, the same effect obtained by providing the movable idle roller 60 can be achieved, and the cost can be reduced while maintaining the reliable operation.

While the embodiments of the invention was fully explained, the present invention is not limited to such embodiments. For example, in the above explanation, while an example that the sheets P are stacked on the resting plate 30 in the inclined condition was explained, the present invention can be applied to an arrangement in which sheets are fed in a horizontally stacked condition.

What is claimed is:

1. A sheet feeding apparatus for separating and feeding sheets one by one, comprising:

sheet stacking means for supporting sheets;

a sheet feeding roller, provided at its periphery with a cylindrical surface and a cut-out portion, for feeding out the sheet stacked on said sheet stacking means by means of said cylindrical surface by rotating;

separation means, capable of abutting against said sheet feeding roller, for separating the sheets one by one between said cylindrical surface of said sheet feeding roller and said separation means;

spacing means for spacing apart said sheet feeding roller and said separation means when said cut-out portion of said sheet feeding roller is opposed to said separation means;

biasing means for biasing said separation means to urge it against said sheet feeding roller or said spacing means; and conveying load reducing means for reducing a conveying load acting on the sheet being fed, by making an abutment force for pinching the sheet between said spacing means and said separation means smaller than an abutment force for pinching the sheet between said cylindrical surface and said separation means.

2. A sheet feeding apparatus according to claim 1, wherein said separation means comprise a separation pad, and said conveying load reducing means include opposite direction biasing means for biasing said separation pad toward a direction opposite to a biasing direction of said biasing means when said separation means is biased toward said spacing means by said biasing means, and a biasing force of said biasing means is set to be greater than a biasing force of said opposite direction biasing means.

3. A sheet feeding apparatus according to claim 2, wherein said opposite direction biasing means biases said separation pad toward the direction opposite to the biasing direction of said biasing means only when said separation pad is opposed to said spacing means.

4. A sheet feeding apparatus according to claim 3, wherein said opposite direction biasing means includes a pressure reduction lever rotatably provided and capable of engaging with said separation pad, and a pressure reduction spring for biasing said pressure reduction layer, so that said pressure reduction lever biases said separation pad toward the direction opposite to the biasing direction of said biasing means by said pressure reduction spring.

5. A sheet feeding apparatus according to claim 1, wherein said spacing means comprise an idler sub-roller coaxial with said sheet feeding roller.

6. A sheet feeding apparatus according to claim 1, wherein said sheet stacking means can be shifted toward and away from said sheet feeding roller as said sheet feeding roller is rotated, and said sheet feeding roller as said sheet feeding roller is rotated, and said sheet stacking means is approach to said sheet feeding means when the sheet is fed out.

7. A sheet feeding apparatus for separating and feeding sheets one by one, comprising:

sheet stacking means for supporting sheets;

a sheet feeding roller, provided at its periphery with a cylindrical surface and a cut-out portion, for feeding out the sheet stacked on said sheet stacking means by means of said cylindrical surface by rotating;

separation means, capable of abutting against said sheet feeding roller, for separating the sheets one by one between said cylindrical surface of said sheet feeding roller and said separation means;

an idler sub-roller, disposed in coaxial with said sheet feeding roller, for spacing said sheet feeding roller and said separation means apart from each other when said cut-out portion of said sheet feeding roller is opposed to said separation means;

biasing means for biasing said separation means toward said sheet feeding roller;

drive control means for rotating said sheet feeding roller to feed out the sheet and for stopping said sheet feeding roller at a position where said cut-out portion is opposed to said separation means; and conveying load reducing means for stopping said sheet feeding roller on the way of the sheet feeding by said drive control means, by setting an abutment force for pinching the sheet between said idler sub-roller and said separation means to be smaller than an abutment force for pinching the sheet between said cylindrical surface and said separation means, thereby more reducing a conveying load acting on the sheet when the sheet is pinched between said idler sub-roller and said separation means than when the sheet is pinched between said cylindrical surface and said separation means.

8. A sheet feeding apparatus according to claim 7, wherein said separation means comprise a separation pad, and said conveying load reducing means include opposite direction biasing means for biasing said separation pad in a direction along which said separation pad and said idler sub-roller are spaced apart from each other when said sheet feeding roller is stopped, and a biasing force of said biasing means is set to be greater than a biasing force of said opposite direction biasing means.

9. A sheet feeding apparatus according to claim 8, wherein said opposite direction biasing means includes a pressure reduction lever rotatably provided and capable of engaging with said separation pad, and a pressure reduction spring for biasing said pressure reduction layer, so that said pressure reduction lever biases said separation pad toward the direction opposite to the biasing direction of said biasing means by said pressure reduction spring.

10. A sheet feeding apparatus according to claim 9, by setting a diameter of said idler sub-roller to be smaller than a diameter of said cylindrical surface of said sheet feeding roller, the biasing force of said biasing means when said separation means is urged against said idler sub-roller becomes smaller than the biasing force of said biasing means when said separation means is urged against said sheet feeding roller.

11. A sheet feeding apparatus according to claim 8, wherein a coefficient of friction of a portion of said separation pad opposed to said sheet feeding roller is set to be smaller than a coefficient of friction of a portion of said separation pad opposed to said idler sub-roller.

12. A sheet feeding apparatus according to claim 7, further comprising pressing means for always urging the sheet fed out by said sheet feeding roller against said separation means, and wherein said pressing means includes an idler sub-roller biased from said sheet feeding roller toward said separation means.

13. A sheet feeding apparatus according to claim 7, wherein said sheet feeding roller is provided with a protruded portion at a position corresponding to a stepped portion near a rearmost part where said sheet feeding roller is stopped, among stepped portions defined between said sheet feeding roller and said idle roller coaxial with said sheet feeding roller.

14. An image forming apparatus for forming an image on a sheet, comprising:

sheet stacking means for supporting sheets;

a sheet feeding roller, provided at its periphery with a cylindrical surface and a cut-out portion, for feeding out the sheet stacked on said sheet stacking means by means of said cylindrical surface by rotating;

separation means, capable of abutting against said sheet feeding roller, for separating the sheets one by one between said cylindrical surface of said sheet feeding roller and said separation means;

spacing means for spacing apart said sheet feeding roller and said separation means when said cut-out portion of said sheet feeding roller is opposed to said separation means;

biasing means for biasing said separation means to urge it against said sheet feeding roller or said spacing means;

conveying load reducing means for reducing a conveying load acting on the sheet being fed, by making an abutment force for pinching the sheet between said spacing means and said separation means smaller than an abutment force for pinching the sheet between said cylindrical surface and said separation means;

conveying means for conveying the sheet fed out by said sheet feeding roller; and image forming means for forming an image on the sheet conveyed by said conveying means.

15. An image forming apparatus for forming an image on a sheet comprising:

sheet stacking means for supporting sheets;

a sheet feeding roller, provided at its periphery with a cylindrical surface and a cut-out portion, for feeding out the sheet stacked on said sheet stacking means by means of said cylindrical surface by rotating;

separation means, capable of abutting against said sheet feeding roller, for separating the sheets one by one between said cylindrical surface of said sheet feeding roller and said separation means;

an idler sub-roller, disposed in coaxial with said sheet feeding roller, for spacing said sheet feeding roller and said separation means apart from each other when said cut-out portion of said sheet feeding roller is opposed to said separation means;

biasing means for biasing said separation means toward said sheet feeding roller;

drive control means for rotating said sheet feeding roller to feed out the sheet and for stopping said sheet feeding roller at a position where said cut-out portion is opposed to said separation means;

conveying load reducing means for stopping said sheet feeding roller on the way of the sheet feeding by said drive control means, by setting an abutment force for pinching the sheet between said idler sub-roller and said separation means to be smaller than an abutment force for pinching the sheet between said cylindrical surface and said separation means, thereby more reducing a conveying load acting on the sheet when the sheet is pinched between said idler sub-roller and said separation means than when the sheet is pinched between and separated by said cylindrical surface and said separation means;

conveying means for conveying the sheet fed out by said sheet feeding roller; and image forming means for forming an image on the sheet conveying by said conveying means.

* * * * *

UNITED STATES PATENT AND TRADEMARK OFFICE

CERTIFICATE OF CORRECTION

PATENT NO. : 6,331,002 B1
DATED : December 18, 2001
INVENTOR(S) : Hiroshi Yoshino et al.

It is certified that error appears in the above-identified patent and that said Letters Patent is hereby corrected as shown below:

Column 1,
Line 42, “biased” should read -- biased by --.

Column 2,
Line 6, “abut” should read -- abuts --.
Line 18, “abut” should read -- abuts --.
Line 31, “a” should read -- is --.

Column 5,
Line 28, “in synchronous” should read -- synchronously --.

Column 8,
Line 59, “abut” should read -- abuts --.

Column 9,
Line 26, “was” should read -- were --.

Column 10,
Line 10, “layer,” should read -- lever, --.
Line 21, “is approach” should read -- approaches --.
Line 34, “in coaxial” should read -- coaxially --.

Column 12,
Line 21, “in coaxial” should read -- coaxially --.

Signed and Sealed this

Twentieth Day of August, 2002

*Attest:*

*Attesting Officer*

JAMES E. ROGAN
*Director of the United States Patent and Trademark Office*